United States Patent [19]

Kaelin

[11] 4,094,093

[45] June 13, 1978

[54] DOLL HAVING SELF-SUPPORTING SITTING AND STANDING POSITIONS

[75] Inventor: Bette M. Kaelin, Chicago, Ill.

[73] Assignee: Marvin Glass & Associates, Chicago, Ill.

[21] Appl. No.: 715,526

[22] Filed: Aug. 18, 1976

[51] Int. Cl.[2] ..... A63H 3/02

[52] U.S. Cl. ..... 46/160; 46/159; 46/163; 46/DIG. 1

[58] Field of Search ..... 46/151, 162, 163, 158, 46/159, 115, 145, 161, 119

[56] References Cited

U.S. PATENT DOCUMENTS

| | | | |
|---|---|---|---|
| 1,409,411 | 3/1922 | Rogers | 46/162 |
| 1,583,284 | 3/1926 | Dykman | 46/151 |
| 2,078,809 | 4/1927 | Richman | 46/151 |
| 3,828,467 | 8/1974 | Kaelin | 46/115 |

*Primary Examiner*—F. Barry Shay
*Attorney, Agent, or Firm*—Mason, Kolehmainen, Rathburn & Wyss

[57] ABSTRACT

A rag doll which is capable of being selectively manipulated or adjusted to assume either a standing or a sitting posture. The doll includes a combined head and torso portion formed of flexible covering material filled with soft, supporting stuffing material. Arms formed of the same type of material are attached to the torso. At the bottom of the torso a pair of upwardly extending receivers having bottom openings are recessed in and extend upwardly into the torso for receiving a pair of leg members by sliding snug fit such that the lower portions of the leg members, which terminate in flat-soled feet, extend from the receivers for supporting the doll in a standing position. The leg members can be moved outwardly from the receivers but are secured against complete withdrawal by flexible strap members secured to the upper portion of the leg members at one end and secured at the top of the receivers at the other end. The strap members are of a length permitting sufficient withdrawal of the leg members to eliminate the snug fit and the uppermost portion of each leg is sufficiently flexible so that the legs can be moved to a sitting position.

4 Claims, 6 Drawing Figures

14
20
22
50
52
38
40
16
18
24
20
22
27
36
12
30a
34
44
32
20
22
20
46
48

14
22
38
50
20
30
12
30a
44
22
20
48

DOLL HAVING SELF-SUPPORTING SITTING AND STANDING POSITIONS

BACKGROUND OF THE INVENTION

This invention relates to a toy doll which is capable of being selectively manipulated to assume either a standing or sitting position.

SUMMARY OF THE INVENTION

The present invention provides a new and useful toy doll having the capability of being placed in either upright or sitting positions. The doll includes legs and a torso, the torso having leg receiving means recessed in the bottom thereof. When the doll is in standing or upright position, appendages such as legs are received within the receiving means to an extent sufficient to support the doll but the legs may be withdrawn from the receivers to the extent sufficient to move them into a doll sitting position. The legs are attached to the torso within the receivers by a flexible system which prevents total withdrawal of the legs from the receivers so that the legs do not become totally separated from the torso.

While this invention is susceptible of embodiment in many different forms there is shown in the drawings and will be described in detail a specific embodiment thereof, with the understanding that the present disclosure is to be considered as an exemplification of the principles of the invention and is not intended to limit the invention to the embodiment illustrated.

DESCRIPTION OF THE PREFERRED EMBODIMENT

Figure 2:
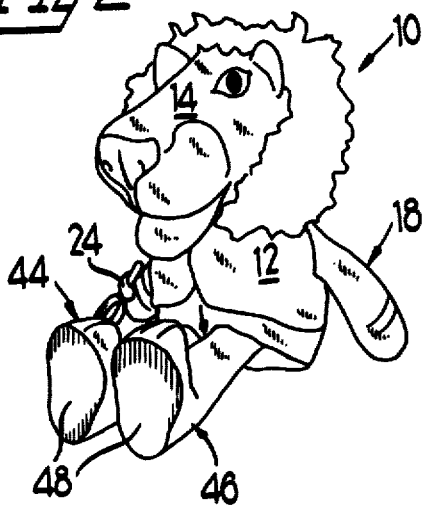
FIGS. 1 and 2 are perspective views of a form of toy doll of this invention showing the doll in standing and sitting positions respectively.
Figure 1:
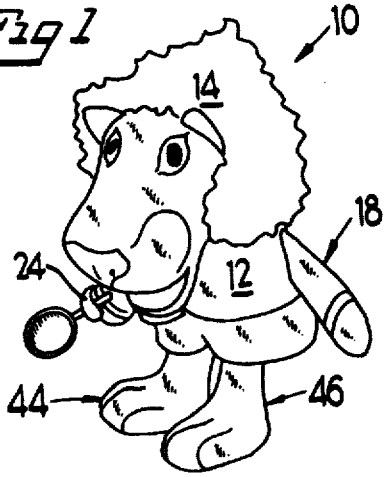

Turning now more specifically to the drawings, the preferred embodiment of the present invention is a toy figure (FIGS. 1 and 2) in the form of a doll 10 having a main body including a torso 12, a head 14 which is integral or connate with the torso 12, and a pair of appendages such as arms 16 and 18 hingedly attached to the upper portion of torso 12 for swinging movement relative to torso 12. The doll 10 is a "rag" doll intended for play by a child in such a manner that the doll can be placed in an upright or standing position as seen in FIG. 1 or in a sitting position as seen in FIG. 2.

Figure 5:
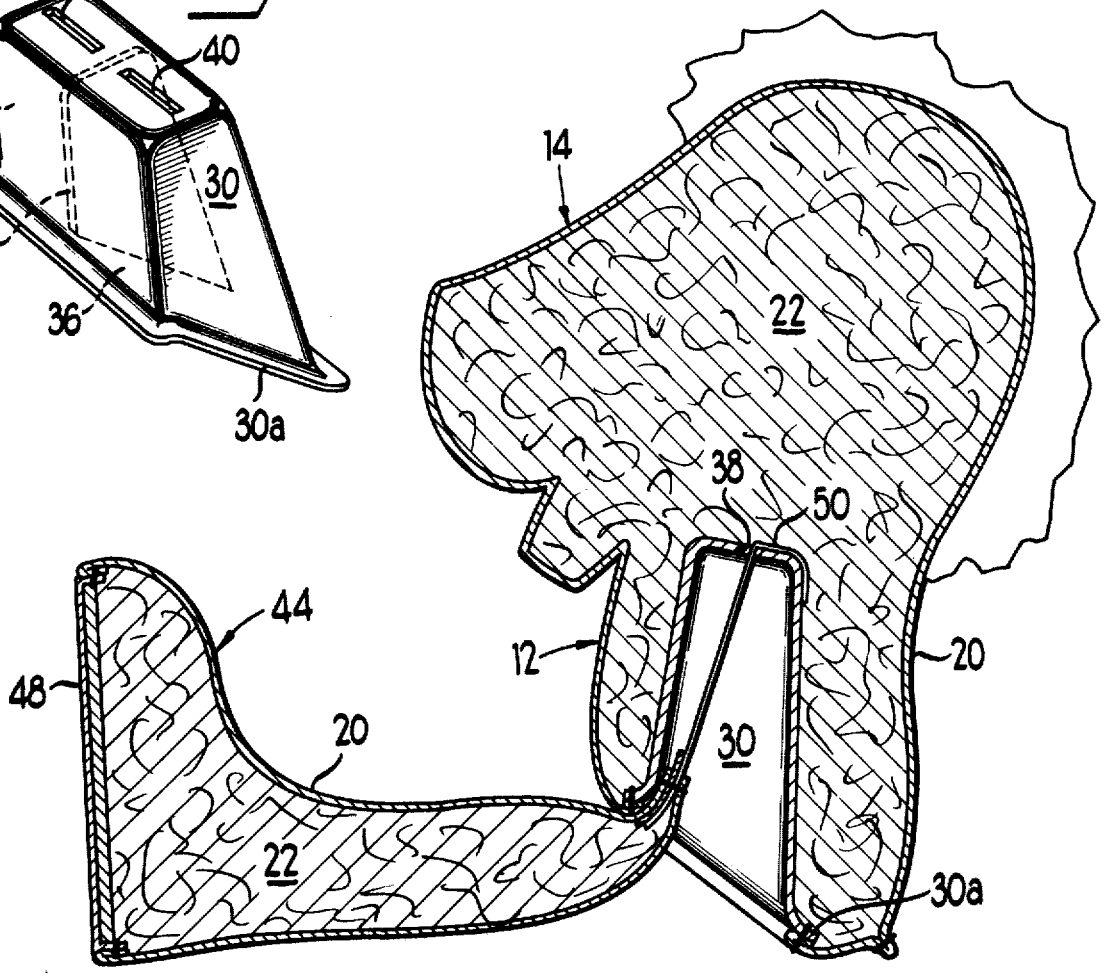
FIG. 5 is a section as in FIG. 4 but showing the doll in a sitting position.
Figure 3:
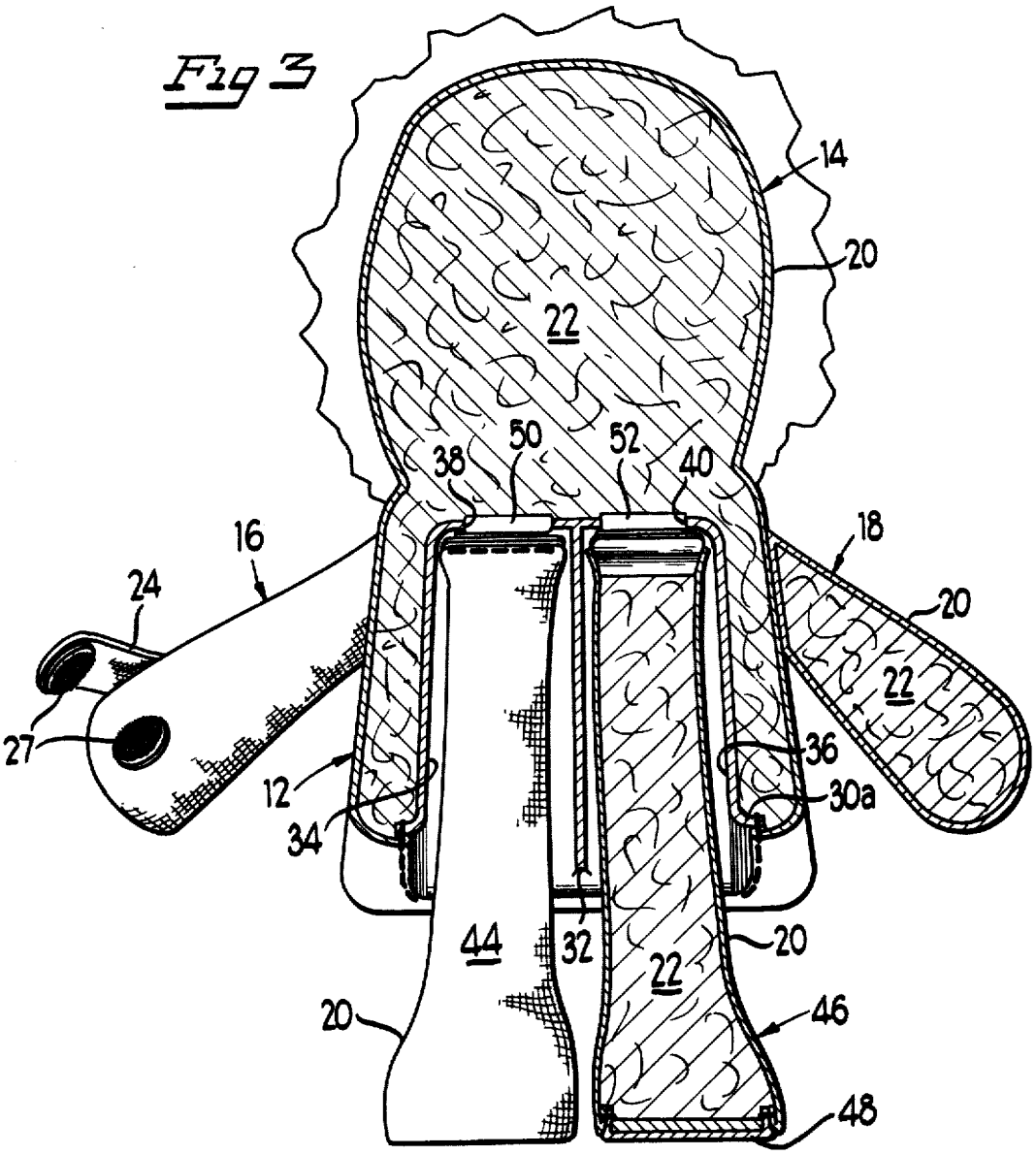
FIG. 3 is an enlarged, vertical and generally frontal section through the toy doll of FIG. 1.
Figure 4:
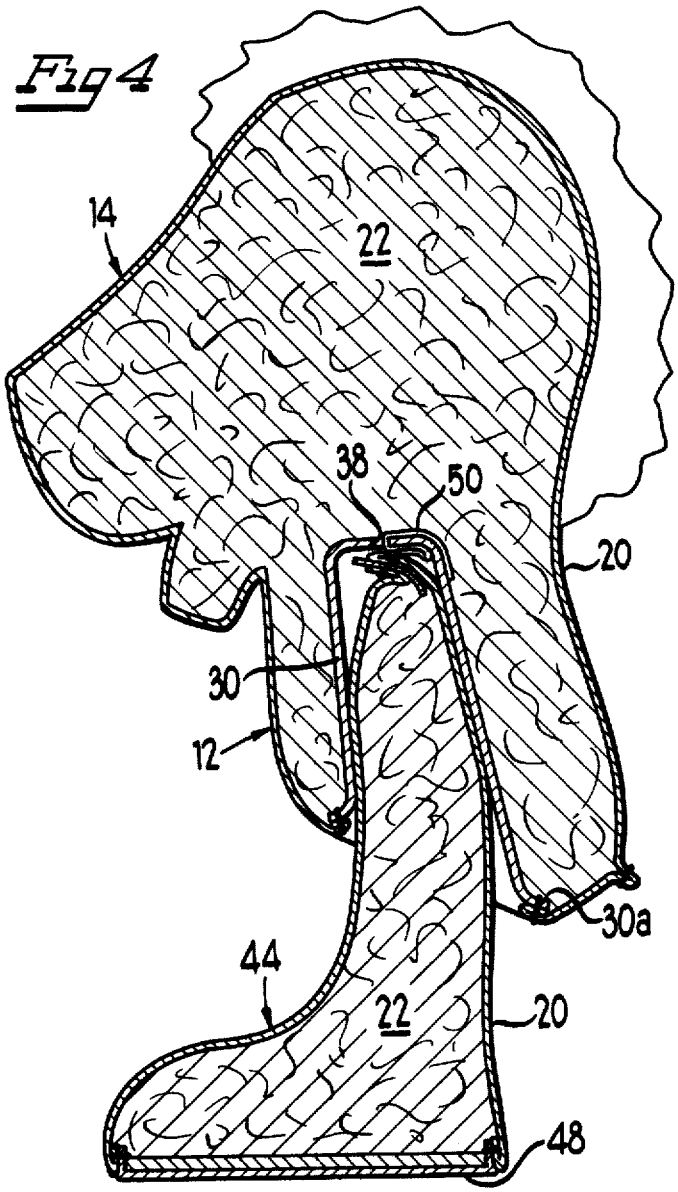
FIG. 4 is a section taken generally along line 4—4 of FIG. 3.

Turning now more specifically to the structure of the doll 10 as shown in FIGS. 3 through 5 the main body of the doll, i.e., torso 12, head 14 and arms 16 and 18, is composed of an outer skin of soft flexible covering material 20 which encloses a soft stuffing material 22 such as cotton, rags, foam rubber, or the like, as is common in "rag" dolls. On arm 16 (FIG. 3) a flexible flap 24 is hingedly secured to the cover material 20 near the distal end of the arm. The flap 24 can be of the same material as covering material 20 and the flap 24 and arm 16 are each provided with a portion of a friction-type snapping system 26 of a conventional type, shown as the type formed of opposing layers of synthetic plastic bristle material which is commercially available, e.g., under the trademark VELCRO. During play by the child, a toy implement 27 (FIG. 1) or the like can be placed beneath flap 24 and the snap system 26 can then be closed to simulate holding the implement 27 by the doll.

Figure 6:
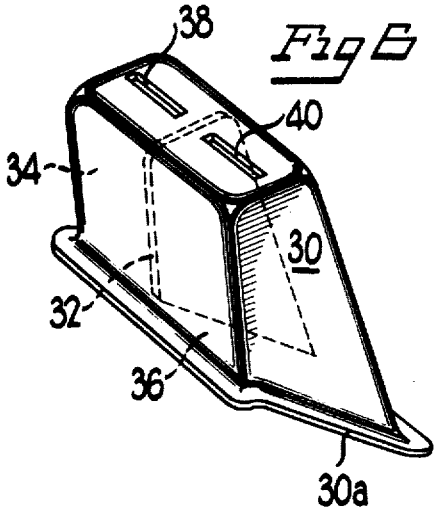
FIG. 6 is a perspective view of a leg receiver shell used in the doll of FIGS. 1 through 5.

The torso 12 has a bottom recess formed and lined by a shell 30 (FIGS. 3 through 6) of rigid or semi-rigid material, usually plastic. The shell 30 has an outwardly projecting flange-like lip 30*a* around an angular bottom opening tapering downwardly toward the rear of the doll as seen in FIG. 5 and flange 30*a* is accordingly similarly angular relative to the center line of shell 30, for reasons described hereinbelow. The lip 30*a* is secured to the inner surface of cover material 20 about the periphery of an opening in cover material 20 at the bottom of torso 12 so that the shell 30 projects upwardly within torso 12. Shell 30 has a central or medial septum 32 (FIGS. 3 and 6) defining separate compartments or receivers 34 and 36 within shell 30. Shell 30 is also provided with slots 38 and 40 in the top wall thereof, each of the slots 38, 40 opening into and communicating with one of the receivers.

The remainder of the toy figure or doll 10 is made up of a second pair of appendages such as legs 44 and 46 (see especially FIGS. 1 through 3) each leg having a foot portion with a flat rigid or semi-rigid sole plate as at 48 secured to the bottom of the leg to assure a flat surface for standing purposes. Each leg is made up from covering material 20 and stuffing material 22 and the legs are stiff enough to support the doll in standing position. The plate 48 can be conveniently secured to the covering material 20 by adhesive or other means. The legs 44, 46 are sized to snug fit in their respective receivers, 34, 36.

A flexible tape or strap 50, 52 (FIGS. 3 through 5) is secured to the upper end of a leg 44, 46 and protrudes through slot 38, 40 and is secured at its upper distal end to the outer surface of shell 30. The legs 44, 46 are snugly slidably receivable in the receivers 34, 36 so that the doll 10 may be positioned in an upstanding stance as in FIGS. 1, 3 and 4.

To place the doll in the sitting position as shown in FIG. 2, the legs 44, 46 are removed or withdrawn from the receivers 34, 36 and the straps 50 and 52 which join the legs 44 and 46 to the shell 30 are of proper length to retain the legs from being completely withdrawn and hold at least a thin flexible upper terminal portion of each leg within the receivers 34 and 36 to properly simulate a sitting doll. For this purpose the upper ends of the legs 44, 46 near and at the attachment of straps 50, 52 are thinner and bendable relative to the remainder of the legs so that the legs can be moved or bent into a sitting position. In sitting position the upper portions of the legs also help to stabilize and support the doll (FIG. 5). In addition, the shape of shell 30 and particularly the angular opening and lip 30*a* provide a generally rigid support for the lowermost end of the torso 12 to give stability to the doll while in sitting position.

The foregoing detailed description has been given for clearness of understanding only and no unnecessary limitations should be understood therefrom as some modifications will be obvious to those skilled in the art.

I claim:

1. A doll, comprising:

a torso portion;

a pair of legs; and means for securing the legs to the torso for movement between a self-supporting standing position and a self-supporting sitting position, said means comprising a receiver mounted within the torso of the doll for accepting and concealing a substantial length of the legs to permit the doll to be supported by said legs in a standing position while permitting movement of said legs outwardly relative to said receiver to support the doll in a sitting position, and a flexible strap for each leg, one end of each strap being secured to the top of the respective leg and having the other end of the strap secured within the receiver.

2. The doll of claim 1 wherein each of said leg members terminates at its lower or distal end in a foot portion having a sole defined by a flat bottom plate for assuring balanced support of the doll when placed on a flat supporting surface in standing position.

3. The doll of claim 1 wherein said receiver is constructed and size to slidably receive and retain the legs by snug fit with the upper portions of the legs, the lower portions extending outwardly from said receiver for supporting the doll in a standing position.

4. A doll capable of being manipulated to assume either standing or sitting positions in self-supporting relationship on a supporting surface comprising a torso with an integral head at the top thereof and a pair of arm-like appendages attached to the torso, said torso, head and arm-like appendages all being formed of soft, flexible covering material containing soft supporting stuffing material, a pair of receivers recessed in said torso, said receivers each having an opening at the bottom of said torso, a pair of leg members each constructed and sized to have its upper portion fit within one of said receivers in relation therewith whereby said doll may be supported by said leg members in a standing position on a supporting surface, and flexible means fixedly secured to said torso attaching each of said leg members to said torso within a respective one of said respective receivers, said flexible means allowing withdrawal of said legs from said receivers and having sufficient flexibility to permit placing said doll in sitting position but retaining said leg members against complete removal from the torso.

* * * * *